US005375505A

United States Patent [19]

Sutton

[11] Patent Number: 5,375,505

[45] Date of Patent: Dec. 27, 1994

[54] DYNAMIC ROTATING BALLISTIC SHIELD

[75] Inventor: James C. Sutton, Springfield, Va.

[73] Assignee: The United States of America as represented by the Secretary of the Army, Washington, D.C.

[21] Appl. No.: 22,234

[22] Filed: Feb. 25, 1993

[51] Int. Cl.[5] ..... F41H 5/18

[52] U.S. Cl. ..... 89/36.03; 109/49.5; 89/36.14

[58] Field of Search ..... 109/49.5; 89/36.01, 89/36.03, 36.13, 36.14

[56] References Cited

U.S. PATENT DOCUMENTS

| | | | |
|---|---|---|---|
| 330,638 | 11/1885 | Timby | 89/36.13 |
| 1,151,116 | 8/1915 | Miezejewski | 109/49.5 |
| 1,578,310 | 3/1926 | Campbell, Jr. et al. | 89/36.13 |
| 2,358,257 | 9/1944 | Schwab | 89/36.03 |
| 2,360,850 | 10/1944 | Colby | 89/36.14 |
| 3,493,296 | 2/1970 | Albert | 89/36.14 |

FOREIGN PATENT DOCUMENTS

| | | | |
|---|---|---|---|
| 402515 | 3/1943 | Italy | 89/36.03 |
| 1238345 | 7/1971 | United Kingdom | 89/36.14 |

*Primary Examiner*—Stephen M. Johnson
*Attorney, Agent, or Firm*—Milton W. Lee; Alain L. Bashore; Anthony T. Lane

[57] ABSTRACT

A dynamic rotating ballistic shield for protecting an enclosed viewing device. A rotating inner armor sleeve around the device includes a sleeve opening. When the sleeve aligned with a cap opening of an outer armor cap which concentrically surrounds the rotatable inner armor sleeve, a substantially unobstructed field-of-view for the objective window is obtained, with substantial ballistic shield protection.

2 Claims, 2 Drawing Sheets

DYNAMIC ROTATING BALLISTIC SHIELD

BACKGROUND OF INVENTION

1. Field of the Invention

The present invention generally relates to ballistic shields and more particularly to dynamic rotating ballistic shields for protecting instruments and equipment used in a hostile environment.

2. Description of Related Prior Art

Instruments and equipment such as viewing devices utilize an objective window through which "information" from a surrounding environment is detected. Such objective windows must be transparent to the specific frequency spectrum so as not to impair the functioning of the device yet also physically protect the device. Typical transparent materials used are notoriously weak to physical damage. In hostile environments such as on the battlefield a typical shellburst throws a fragment at an average velocity of 2000 feet per second. A fragment which breaks an objective window may cause shell fragments, window fragments from a solid transparent window (if present), and other parts to damage or jam internal parts. An example of such a viewing device is night vision enhancement devices.

Current Army's armor protection has not provided continuous protection while the night vision enhancement device is functioning. Protection of objective windows for the Forward Looking Infrared (FLIR) device is provided by armor doors which can be opened or closed. When open, no protection is provided but maximum FLIR performance is obtained. When closed, maximum protection is provided but with no FLIR visibility. For the Commander's independent thermal tank viewer (CITV), protection is attempted by handing of materials and special internal placement for continued operation after damage of the objective window. Prolonged operation with a broken or missing window will still result in internal corrosion and contamination.

While the prior art has reported using ballistic shields with attached viewing devices, none have established a basis for a specific apparatus that is dedicated to resolve the particular problem at hand.

What is needed in this instance is a ballistic shield which provides continuous protection whether or not the protected equipment is mounted and operational, and to insure that no substantial degradation of operational performance occurs.

SUMMARY OF THE INVENTION

It is therefore the primary object of the invention to provide continuous ballistic shield protection for a viewing device normally attached to a vehicle in the field, without substantial operational impairment.

According to the invention, there is disclosed a dynamic rotating ballistic shield for protecting the objective window of a device. An inner armor sleeve rotatable about the viewing device includes a sleeve opening. During sleeve rotation the sleeve opening intermittently corresponds to a cap opening in an outer armor cap which concentrically surrounds the side and top of the rotatable inner armor sleeve. The objective window and cap opening are movable in direct correspondence in an alternative embodiment.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT

Figure 1:
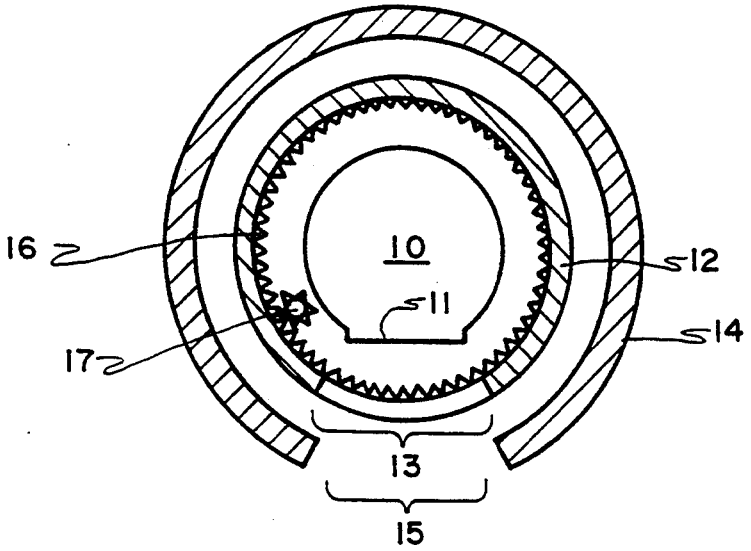
FIG. 1 is a cutaway top view of the invention with aligned inner armor sleeve.

Referring now to the drawings, and more particularly to FIG. 1, there is shown a cutaway top view of the invention. The attached instrument or viewing device 10 includes objective window 11 through which information from the surrounding environment is detected. Device 10 concentrically surrounds inner armor sleeve 12 with a sleeve opening 13 within the sleeve wall. Outer armor cap 14 with cap opening 15 within the cap wall concentrically surrounds inner armor sleeve 12. As shown in FIG. 1, sleeve opening 13 is in alignment with objective window 11 such that an unobstructive view is available for objective window 11 of attached viewing device 10. A means for rotation is shown integral with and approximate to the bottom of inner armor sleeve 12 with gear teeth 16 engaged with the engagement gear 17 to provide a motive power source to allow a continuous rotation of the inner armor sleeve 12. Outer armor cap 14 is coupled to device 10 such that by rotational movement of device 10 there is corresponding rotational movement of outer armor cap 14. It is understood that the means for rotation disclosed above is the preferred embodiment but that any suitable means for providing rotational capability may be used. It is also understood that cap opening 15 is always in alignment with objective window 11.

Figure 2:
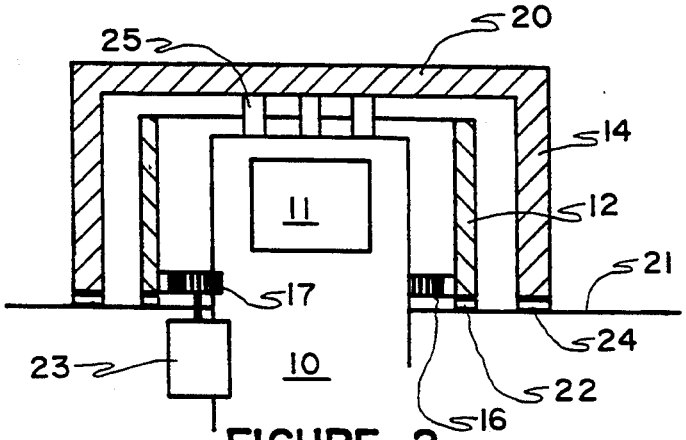
FIG. 2 is a cutaway frontal view of the invention with aligned inner armor sleeve.

FIG. 2 discloses a cutaway frontal view of the invention with aligned objective window 11 of attached viewing device 10, inner armor sleeve 12 and outer armor cap 14. Outer armor cap 14 includes a cap top 20 which functions to protect device 10 from above base 21 of which device 10 protrudes. Inner armor sleeve 12 is shown which includes roller means 22 as rotational means, such as a roller bearing seal, which allows inner armor sleeve 12 to be movable on base 21. Engagement gear 17 is shown in FIG. 2 coupled to motored power source 23 provides the motive power for rotating inner sleeve 12. Also shown, is roller bearing seal 24 which allow outer armor cap 14 to rotate freely as another rotational means. Coupling elements 25 physically couple device 10 to outer armor cap 14 so that when device 10 is rotated there is corresponding rotational movement of outer armor cap 14 as discussed above. It is understood that the rotational means disclosed above is the preferred embodiment but that any suitable rotational means may be used.

Figure 3:
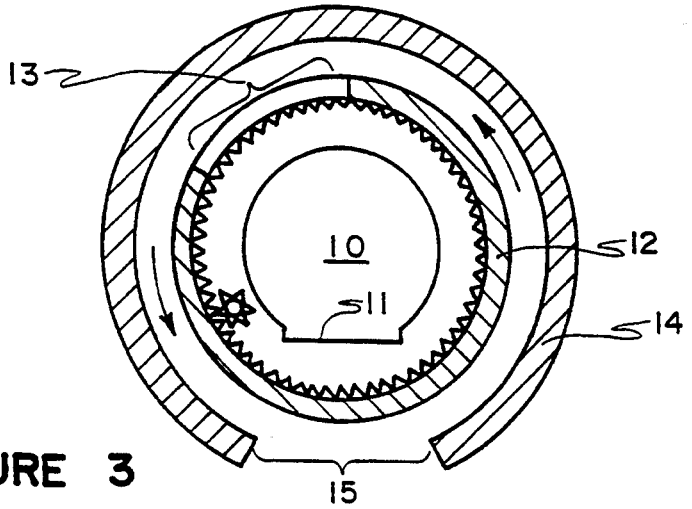
FIG. 3 is a cutaway top view of the invention with non-aligned inner armor sleeve.
Figure 4:
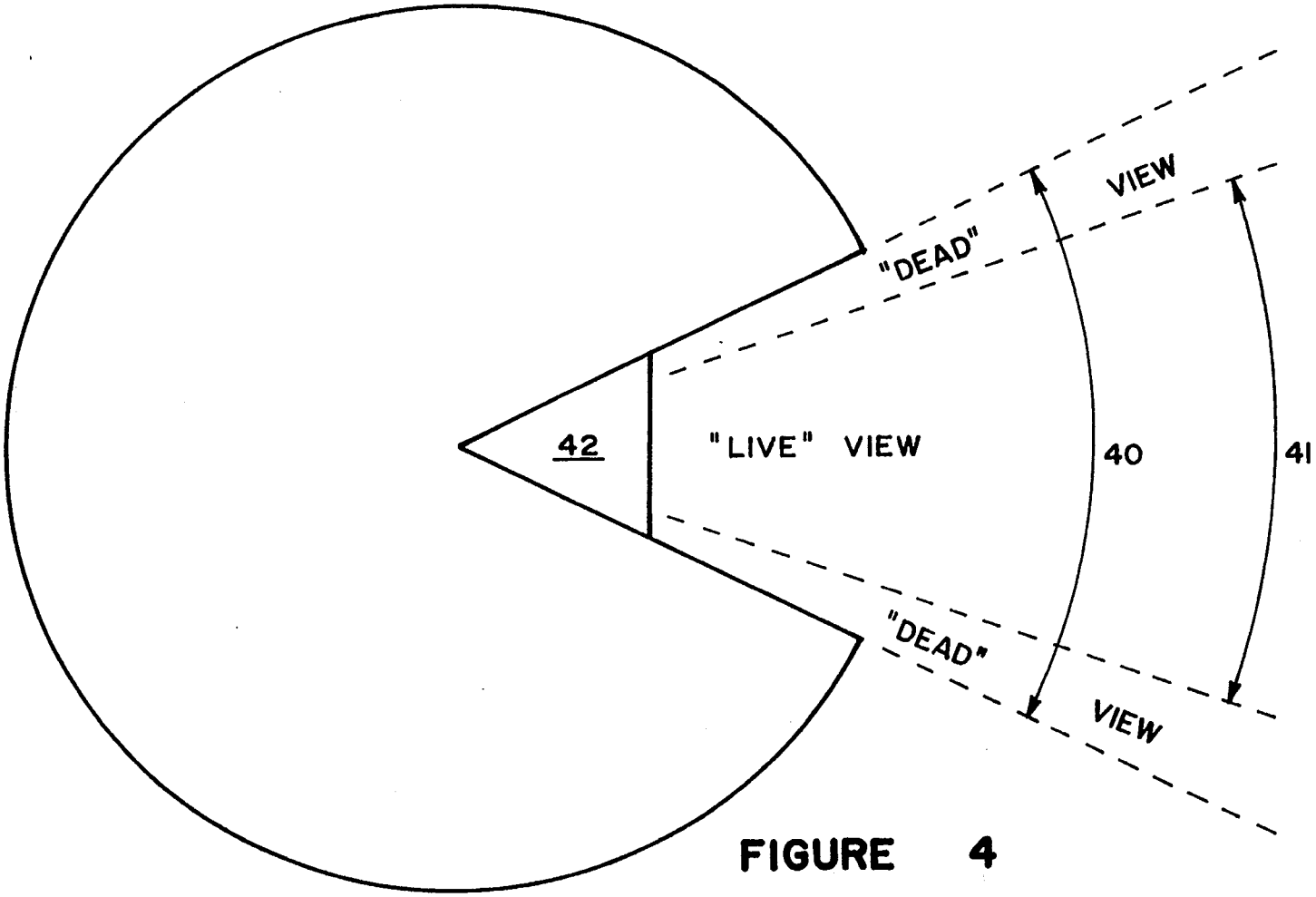
FIG. 4 is a pictorial representation of a viewing angle pictorial view of the invention.

In an alternative embodiment motorized power source 23, along with engagement gear 17 would be used to provide continuous rotational capability to outer armor cap 14 not physically coupled to device 10. Outer armor cap 14 would have similar gear teeth, integral to cap 14, proximate to the bottom of armor cap 14. Inner armor sleeve 12 in the alternative embodiment would be coupled, or integral to, device 10 such that objective window 11 would correspond to viewing alignment with inner armor sleeve opening 15 while outer armor cap would continuously rotate. FIGS. 3 and 4 will next be discussed for a description of the operation of the invention.

FIG. 3 is a top cutaway view of the invention showing inner armor sleeve 12 not in alignment with aligned objective window 11 and cap opening 15. This non-aligned condition occurs during the continuous rotation of inner armor sleeve 12 and this time out of alignment will depend on the rotational rate of inner armor sleeve 12. As rotational speed of inner armor sleeve 12 increases (or outer armor cap 14 in the alternative embodiment) there is an increase in viewing quality obtained with a resultant decrease in percent protection of the device being protected. Since there is an intermittent physical obstruction of the field-of-view, caused by rotational movement of inner sleeve 12 over the entire field-of-view, a relatively small viewing angle on each extreme end of the entire angle of view will be obstructed as "dead". FIG. 4 depicts a theoretical field-of-view 40 of which because of the rotational speed of inner armor sleeve 30 of FIG. 3 causes a non-viewing areas shown in FIG. 4 as "dead" view such that actual field-of-view 41 is the "live" view available to objective window 42.

In the preferred embodiment a Commander's Independent Thermal Tank Viewer (CITV), Driver's Thermal Viewer (DTV), or Driver's Viewer (AN/VVS-2) is the attached viewing device with an approximate diameter of 10 to 12 inches, placed through a tank surface which consists of two inch armor plate. A 25 hertz frame rate from a CCD television camera requiring a 0.2 second of unobscured viewing is utilized. For a 5.28 second per inner armor sleeve rotation with a 6-inch sleeve opening yields a 87% theoretical protection from damage.

While this invention has been described in terms of a preferred embodiment consisting of a CITV on a tank surface, those skilled in the art will recognize that the invention can be practiced with modification within the spirit and scope of the appended claims.

I claim:

1. A dynamic rotating ballistic shield assembly for protecting at least an objective window which views a hostile environment including:

a base for supporting said dynamic rotating ballistic shield assembly around which at least said objective window projects above said base;

a cylindrical rotatable inner armor sleeve surrounding the objective window, where the sleeve includes a side and top surface, rotatable on said base with a side sleeve opening approximate in size to the objective window;

a rotation means coupled to said cylindrical inner armor sleeve for providing rotational movement to the cylindrical inner armor sleeve;

a cylindrical rotatable outer armor cap concentrically surrounding the rotatable inner armor sleeve, the cylindrical outer armor cap also rotatable on said base and rotatively coupled to the objective window, further including a side cap opening which approximates the inner sleeve opening, whereby any rotational movement of the objective window provides corresponding rotational movement of the outer armor cap such that continuous alignment of the objective window and said side cap opening is achieved, while continuous rotation of the inner armor sleeve allows for a substantially unobstructed field-of-view of the objective window while providing substantial ballistic shield protection without substantial viewing impairment regardless of the objective window viewing angle.

2. The dynamic rotating ballistic shield of claim 1 wherein the rotation means further includes:

gear means integral with the inner armor sleeve;

gear engagement means proximate to the gear means which engage the gear means for rotational movement of the inner armor sleeve;

power means coupled to the gear engagement means to provide power to the gear engagement means such that continuous rotational capability is provided to the inner armor sleeve.

* * * * *